United States Patent [19]

Rabitsch et al.

[11] 4,379,061

[45] Apr. 5, 1983

[54] DETERGENT COMPOSITION WITH REDUCED SOIL-REDEPOSITION EFFECT

[75] Inventors: Hermann Rabitsch, Vienna, Austria; Helmut A. Sosath, Mannheim, Fed. Rep. of Germany

[73] Assignee: Lever Brothers Company, New York, N.Y.

[21] Appl. No.: 331,720

[22] Filed: Dec. 17, 1981

[30] Foreign Application Priority Data

Dec. 17, 1980 [GB] United Kingdom ..... 8040445

[51] Int. Cl.[3] ..... C11D 3/20; C11D 3/22

[52] U.S. Cl. ..... 252/174.18; 252/174.17; 252/174.23; 252/174.24; 252/DIG. 2

[58] Field of Search ..... 252/174.17, 174.18, 252/174.23, 174.24, DIG. 2

[56] References Cited

U.S. PATENT DOCUMENTS 3,523,088 8/1970 Dean et al. ..... 252/550

3,920,570 11/1975 Mulders ..... 252/174.24

4,100,094 7/1978 Burns et al. ..... 252/135

FOREIGN PATENT DOCUMENTS 2237960 of 1977 France .

*Primary Examiner*—John E. Kittle

*Assistant Examiner*—Robert A. Wax

*Attorney, Agent, or Firm*—Milton L. Honig; James J. Farrell

[57] ABSTRACT

The soil-redeposition effect of detergent compositions of the usual type, containing an active detergent material and a ternary mixture of sodium carboxymethyl cellulose, a linear polycarboxylate and a cellulose ether can be further improved by using as the cellulose ether a particular type of alkyl celluloses, namely those having a $C_1$–$C_3$ alkyl group, a DS of at least 0.5, a DP of not more than 300, and further being free of other substituents.

3 Claims, No Drawings

DETERGENT COMPOSITION WITH REDUCED SOIL-REDEPOSITION EFFECT

The present invention relates to a detergent composition having a reduced soil-redeposition effect.

It is known that during the washing operation insoluble calcium salts are formed, which deposit on the textile materials and thus result in unacceptable incrustations on the textiles. This incrustation is frequently accompanied by a (re)deposition of soil, resulting in a greying of the textile materials. In particular pigmented soil (such as e.g. inorganic salts, minerals, skin particles) appear to present problems in this respect.

In order to keep the removed soil suspended in the washing liquor and to reduce the formation of insoluble calcium salts, the detergent industry for a long time has been using builders, among which the phosphates, particularly sodium tripolyphosphate, are the most widely used.

A reduction of the phosphate content, which is now increasingly being aimed at, results however in a decreasing soil-suspending power and an enhanced incrustation of the detergent composition, thus to an enhanced greying of the laundry.

Textiles from synthetic material present problems in other respects: on the ground of their hydrophobic character these textiles show a particular tendency to adsorb oily and fatty soil, which then—dependent on the presence or absence of sufficient tripolyphosphate—causes a greying or yellowing of the laundry, especially because this oily or fatty soil acts as an "adhesive" for pigmented soil, which can then also deposit on synthetics.

To obviate these phenomena several measures have been suggested, such as the use of various cellulose derivatives as soil-suspending agents, and soil-suspending systems comprising cellulose derivatives and other ingredients.

Thus, it has been proposed in FR-PS No. 2,237,960 to use a mixture of a copolymer from maleic acid anhydride and ethylene or methyl vinyl ether and an alkyl hydroxyalkyl cellulose in a detergent composition to achieve an improved inhibition of soil redeposition. In addition to this mixture, the detergent compositions according to this French patent contain sodium carboxy methyl cellulose as a further soil-suspending agent.

The ternary mixture according to this prior art indeed produces generally a quite satisfactory reduction of soil redeposition.

It has been found however, that even a further improved reduction of soil redeposition can be obtained by using in a detergent composition a ternary mixture of sodium carboxy methyl cellulose, a linear polycarboxylate and a particular alkyl cellulose. This ternary mixture produces a generally effective reduction of soil redeposition under the various conditions occurring in practice and on textiles of various kinds, and produces a further improved reduction of soil redeposition in comparison with the already quite effective and satisfactory reduction obtained with the mixtures according to the above-mentioned French patent.

The particular alkyl cellulose is an alkyl cellulose having a low degree of polymerisation (DP) and a relatively high degree of substitution (DS), the latter depending upon the alkyl substituent. The average DS should be at least 0.5, whereas the DP should not exceed 300. The alkyl substituent is methyl, ethyl or propyl. For propylcellulose the DS is at least 0.5, for ethylcellulose at least 0.8 and for the preferred compound methylcellulose the DS is at least 1.5. Alkyl celluloses according to the invention should be substantially free of other substituents, in particular hydroxyalkyl groups.

A very suitable and preferred alkylcellulose is a methyl cellulose with a DS of 1.8 and a DP of 200.

The invention therefore relates to a detergent composition containing a ternary mixture of sodium carboxy methyl cellulose, a linear polycarboxylate and a cellulose ether, and is characterized in that the cellulose ether is a $C_1$–$C_3$-alkyl ether, preferably a methyl ether, having a DP of less than 300 and a DS of at least 0.5, which is substantially free of other substituents, particularly hydroxyalkyl groups. The alkylcellulose is generally used in an amount of from 0.02 to 2, preferably from 0.2 to 1% by weight of the detergent composition.

As sodium carboxy methyl cellulose all the known types can be used, with different degrees of substitution and viscosities. The degree of substitution generally lies between 0.38 and 0.95, and is mostly about 0.7. According to the invention the Na-CMC is used in an amount of from 0.05 to 4% by weight, calculated on the detergent composition. Preferably the amount used is from 0.2 to 2.5% by weight.

The term cellulose as used above is intended to include starch; thus the corresponding alkyl starch ethers and carboxy methyl starches are also suitable. The cellulose-based compounds are however preferred.

Typical examples of linear polycarboxylates are alkali or ammonium salts, preferably sodium salts, of homo- or co-polymers of acrylic acid or substituted acrylic acid, such as e.g. Na-polyacrylate, the sodium salt of the copolymer from acrylic acid and methacrylamide, Na-poly-alpha-hydroxyacrylate, salts of copolymers from maleic acid anhydride and ethylene, acrylic acid, vinyl methyl ethers or styrene, allyl acetate, particularly 1:1 copolymers, if desired also those in which the carboxyl groups have been partly esterified, as well as the sodium salts of poly-asparaginic acid, poly-itaconic acid and polymaleic acid. Such copolymers mostly have relatively low molecular weights, e.g. in the order of from 1000 to 50,000. Other suitable linear polycarboxylates are described e.g. in German Pat. Application No. 2,857,300, U.S. Pat. Nos. 4,203,858 and 4,204,052.

The linear polycarboxylate is generally used in an amount of from 0.1 to 5 wt.%, preferably 0.3 to 2 wt%.

The ternary mixture according to the invention can be incorporated in detergent compositions of any kind. The combination according to the invention can e.g. be applied in detergent compositions which contain an anionic, a nonionic, a cationic synthetic detergent or a soap or mixtures thereof, and additionally contain the usual additives and auxiliary materials for detergents. By soap is to be understood an alkali metal salt, e.g. sodium or potassium salt, of a ($C_{10}$–$C_{24}$) carboxylic acid.

The detergent compositions essentially contain one or more anionic, nonionic, amphoteric or zwitterionic detergent-active compounds or mixtures thereof, and generally builder salts.

The synthetic detergent-active compounds to be used in the compositions according to the invention are preferably anionic detergent-active compounds, which are readily available and relatively cheap, as well as mixtures thereof. These compounds are normally water-soluble alkali metal salts of organic sulphonates or sulphuric acid esters containing alkyl radicals having from about 8 to 22 carbon atoms. Examples of such synthetic anionic detergent-active compounds are sodium or potassium alkyl sulphuric acid esters, in particular those which can be prepared by sulphation of $C_8$–$C_{18}$-fatty alcohols, which can be obtained by reduction of fatty acids originating from tallow or coconut oil, or from synthetic alcohols prepared e.g. by Oxo- or Ziegler-synthesis; sodium or potassium-alkyl ($C_9$–$C_{20}$)-benzene sulphonates, in particular sodium-lin.-sec. alkyl ($C_{10}$–$C_{15}$)-benzene sulphonates; sodium- or potassium alkyl-polyglycolether sulphuric acid esters, particularly from ethers of the higher alcohols which are obtained from tallow or coconut oil or of synthetic higher alcohols; sodium or potassium salts of carboxylic acid monoglyceride sulphates or sulphonates; reaction products of fatty acids, e.g. tallow or coconut fatty acid, with isethionic acid and neutralized with sodium or potassium hydroxide; sodium and potassium salts of fatty acid amides of methyl taurine; alkane monosulphonates, such as those obtained by conversion of $C_8$- to $C_{20}$-alpha-olefins with sodium hydrogen sulphite or by conversion of paraffins with $SO_2$ and $Cl_2$ or $O_2$ and subsequent hydrolysis with sodium or potassium hydroxide; as well as olefin sulphonates, by which term the material is to be understood which is obtained by reaction of olefins, in particular alpha-olefins, with $SO_3$ and subsequent hydrolysis and neutralisation.

Nonionic detergent-active compounds can also be used. Examples are the reaction products of alkylene oxide particularly ethylene oxide, with alkyl ($C_6$–$C_{12}$)-phenols, $C_8$- to $C_{20}$-alkanols, fatty acid amides, in which generally 5 to 30 ethylene oxide units are present per molecule, block polymerisates from propylene oxide and ethylene oxide, condensation products of ethylene oxide with reaction products from propylene oxide with ethylene diamine, etc. Other nonionic detergent-active compounds comprise long-chain tertiary amine- or phosphine-oxide and dialkyl-sulphoxide.

Mixtures of detergent-active compounds, e.g. mixed anionic and mixed anionic and nonionic compounds can be incorporated in the detergent compositions, in particular in order to impart thereto controlled low-sudsing properties. This is particularly favourable for compositions to be used in automatic washing machines that do not allow foaming. Mixtures of amine oxides and ethoxylated, nonionic compounds can also be advantageous.

Many suitable detergent-active compounds are commercially available and have been described in literature, e.g. in "Surface Active Agents and Detergents" by Schwartz, Perry and Berch.

Amounts of amphoteric or zwitterionic detergent-active compounds can also be used in the compositions according to the invention; normally, however, this is undesirable on account of their relatively high cost. If any amphoteric or zwitterionic detergent-active compounds are applied, this is generally done in small amounts in compositions built up from the more frequently used anionic or nonionic detergent-active compounds.

The amount in which the synthetic detergent-active compound or compounds is/are used generally ranges—dependent on the properties desired—from about 5 to 50% by weight, preferably from about 10 to 25% by weight, calculated on the compositions. The detergent compositions can further contain builder salts. Preferably they have a reduced phosphate builder salt content and can even be free of phosphate builder salts. The builder salts used can be inorganic and/or organic builder salts. The weight ratio of the builder salts to the detergent-active compounds generally ranges from about 1:20 to about 20:1, preferably from about 1:3 to about 10:1, and particularly from about 1:1 to about 5:1. Examples of suitable inorganic and organic builder salts are tetrasodium and tetrapotassium pyrophosphate, pentasodium and pentapotassium tripolyphosphate, polymetaphosphates, trisodium- and tripotassium-nitrilotriacetate, etherpolycarboxylates such as sodium glycolate-malonate, citrates, oxidized starch- and cellulose-derivatives, particularly those with dicarboxyl radicals, sodium alkenyl-($C_{10}$–$C_{20}$)-succinates, sodium sulpho fatty acids, alkali metal carbonates and -orthophosphates, sodium aluminosilicates, carboxymethyloxysuccinates. Also several of the above-mentioned polycarboxylates can be considered as builder salts. The preferred builder salts are the condensed phosphates, in particular sodium tripolyphosphate, which may be partly or completely replaced by one or more of the other builder salts mentioned above. The present invention relates in particular to detergent compositions of which the content of phosphates or other builder salts is not sufficient for a complete complexion of the hardness salts present in the washing liquor.

Other conventional materials can be present in the detergent compositions of the invention, e.g. additional soil-suspending agents, hydrotropes, corrosion inhibitors, colorants, perfumes, fillers, optical brighteners, enzymes, lather boosters, foam depressors, germicides, anti-tarnishing agents, fabric softeners, chlorine-releasing agents, nitrogen-releasing bleaching agents such as sodium perborate or percarbonate with or without peracid precursors, buffers and the like. The remainder of the detergent compositions consists of water, e.g. in the range of from about 5 to 15% in the pulverous detergent compositions.

The detergent compositions according to the invention can have any of the usual physical forms for such compositions, such as powders, beads, flakes, bars, tablets, noodles, liquids, pastes and the like. The detergent compositions are manufactured and used in the conventional way; for instance, in the case of powdered detergent compositions they can be made by spray-drying aqueous suspensions of the detergent components or by spray-mixing processes.

The invention will now be further illustrated by the following examples, in which percentages are by weight, calculated on the finished detergent composition.

The experiments were carried out in an Atlas-Launderometer with the following base charge:

| Base Charge: | % |
|---|---|
| sodium dodecyl benzene sulphonate | 13.0 |
| ethylene oxide adduct of a $C_{12}$–$C_{15}$-Oxo alcohol (15 EO) | 7.0 |
| sodium tripolyphosphate | 35.0 |
| sodium disilicate | 5.0 |
| sodium carboxymethylcellulose | x |
| linear polycarboxylate | y |
| nonionic cellulose ether | z |
| foam controllers, sodium sulphate, whiteners, perfumes, water | to 100 |

In this charge the amounts of x, y, z, as well as the types of the linear polycarboxylates and the nonionic cellulose ethers were varied.

The test conditions were as follows:

| | |
|---|---|
| Water hardness: | 6° dH (= 1 mmol/l) or 17° dH (= 3 mmol/l) |
| Temperature: | heating up time: 20 min.; constant at 60° C.: 20 min. |
| Bath ratio: | 1:30 (8 g white test cloth + 2 g soil test cloth in 300 ml wash liquor) |
| Number of tests: | 10 subsequent tests (in which the white test cloth was each time maintained in the 10 subsequent tests, whereas in each test a new soil test cloth was used) |
| Evalutation: | Measure of the decrease in reflection of the white test cloth by means of a Zeiss-Elrepho, Xenon lamp, 620 nm |
| Test cloth: | (a) cotton, soiled with synthetic skin fat (sebum) + pigment (b) soil test cloth EMPA 101 and EMPA 104 ex Eidgenossischer Material-Prufungs-Anstalt, St.Gallen (Switzerland) |
| Dosing of detergent composition: | 2.5 g/l (with this dose at 6° H the amount of tripolyphosphate was sufficient for a complete binding of the $Ca^{2+}$-ions; at 17° dH an "underbuilt" situation was reached). |

In the following Tables the values of x, y and z are given, as well as the test results (Decreases in reflection ΔR).

Since different charges of soil test cloths were used, the test results can only be compared within one series. The soil test cloths used for one particular series were so chosen as to ensure that they all had the same start reflection. By means of measuring the brightening effect on the soil test cloths it was made sure, moreover, that different greyings cannot be ascribed to differences in washing performance.

EXAMPLE I

In this Example compositions according to the invention (1, 2) are compared with one according to the prior art (control).

| Charge | | | Control | (1) | (2) |
|---|---|---|---|---|---|
| x | | | 2.0% | 2.0% | 2.0% |
| y | | | 0.75% | 0.75% | 0.75% |
| z | | | 0.15%(1) | 0.15%(2) | 0.15%(3) |
| Greying of | by soil-test cloth | water hardness °dH | ΔR | ΔR | ΔR |
| Polyester | sebum | 6 | −15.7 | −11.5 | −11.2 |
| | pigment | 17 | −11.2 | −10.4 | −10.0 |
| Popeline | EMPA | 6 | −10.5 | −4.6 | −4.0 |
| | 101 | 17 | −4.6 | −4.1 | −4.5 |

x = carboxy methyl cellulose
y = copolymer from methyl vinyl ether and maleic acid anhydride (hydrolyzed with NaOH and neutralized)
z = cellulose ether
(1) = methyl hydroxyethyl cellulose (DP = 450, $DS_M$ = 1.5, $MS_{EO}$ = 0.1)
(2) = methyl cellulose (DP = 200, $DS_M$ = 1.8)
(3) = methyl cellulose (DP = 100, $DS_M$ = 1.8).

The ternary mixture of the invention produced a clear improvement over the ternary mixture according to French Pat. No. 2,237,960.

EXAMPLE 2

The following compositions 3–5 according to the invention were compared with a binary mixture (Control) that is not in accordance with the invention.

| Charge | | | (3) | (4) | (5) | Control |
|---|---|---|---|---|---|---|
| x | | | 2.0% | 2.0% | 2.0% | 2.0% |
| y | | | 0.75%(1) | 0.75%(2) | 0.75%(3) | — |
| z | | | 0.15% | 0.15% | 0.15% | 0.15% |
| Greying | by soil-test cloth | water hardness °dH | ΔR | ΔR | ΔR | ΔR |
| Popeline | EMPA 104 sebum | 17 | −3.6 | −2.4 | −4.2 | −9.6 |
| | pigment | 17 | −7.7 | −7.2 | −6.7 | −11.8 |
| Polyester/finished cotton (50:50) | EMPA 101 sebum | 17 | −1.7 | −1.9 | −2.3 | −6.2 |
| | pigment | 17 | −4.7 | −5.0 | −5.2 | −9.3 |
| Polyester/finished cotton (65:35) | EMPA 101 sebum | 17 | −0.6 | −0.5 | −2.7 | −5.4 |
| | pigment | 17 | −2.2 | −1.7 | −2.6 | −5.3 |
| | Total | | −20.5 | −18.7 | −23.7 | −47.6 |

x = carboxy methyl cellulose
y = linear polycarboxylate
(1) = copolymer from methyl vinyl ether and maleic acid anhydride (hydrolyzed with NaOH and neutralized)
(2) = Na-polyacrylate
(3) = copolymer from acrylic acid and maleic acid anhydride (hydrolyzed with NaOH and neutralized)
z = methyl cellulose (DP = 200, $DS_M$ = 1.8)

Whereas in Example 1 it appeared that for achieving optimum effects with the cellulose ether it was required to maintain exactly specified characteristics, from the above test results it can be seen that with regard to the use of linear polycarboxylates one may act more freely. In particular from the totals of all reductions in reflection it becomes clear that the three charges with different polycarboxylates can hardly be distinguished from each other; however, it is also clear that all three charges show a distinct improvement over the charge without polycarboxylate.

We claim:

1. Detergent composition with reduced soil-redeposition effect, comprising an active detergent material and a ternary mixture of sodium carboxymethyl cellulose, a linear polycarboxylate and a cellulose ether, characterized in that the cellulose ether is an alkyl cellulose in which the alkyl substituent is a lower alkyl group having 1 to 3 carbon atoms, the degree of substitution is at least 0.5 and the degree of polymerisation is not greater than 300, the alkyl cellulose being essentially free of other substituents.

2. Detergent composition according to claim 1, characterized in that the alkyl substituent is a methyl group.

3. Detergent composition according to claim 1, characterized in that the cellulose ether is used in an amount of from 0.02 to 2 percent by weight of the detergent composition.

* * * * *